US005219018A

United States Patent [19]

Meyer

[11] Patent Number: 5,219,018

[45] Date of Patent: * Jun. 15, 1993

[54] METHOD OF PRODUCING THIXOTROPIC METALLIC PRODUCTS BY CONTINUOUS CASTING, WITH POLYPHASE CURRENT ELECTROMAGNETIC AGITATION

[75] Inventor: Jean-Luc Meyer, Voiron, France

[73] Assignee: Aluminium Pechiney, Courbevoie, France

[ * ] Notice: The portion of the term of this patent subsequent to Oct. 23, 2007 has been disclaimed.

[21] Appl. No.: 637,538

[22] Filed: Jan. 4, 1991

[30] Foreign Application Priority Data

Jan. 4, 1990 [FR] France ..... 90 00516

[51] Int. Cl.[5] ..... B22D 27/02

[52] U.S. Cl. ..... 164/468; 164/504; 164/900

[58] Field of Search ..... 164/466, 467, 468, 502, 164/503, 504, 900

[56] References Cited

U.S. PATENT DOCUMENTS 4,294,304 10/1981 Delassus ..... 164/504
4,964,455 10/1990 Meyer ..... 164/504

FOREIGN PATENT DOCUMENTS 705762 3/1954 United Kingdom ..... 164/504

*Primary Examiner*—Kuang Y. Lin
*Attorney, Agent, or Firm*—Dennison, Meserole, Pollack & Scheiner

[57] ABSTRACT

The invention relates to a continuous casting method for producing thixotropic metallic alloys containing degenerated dendrites. It consists of casting the liquid metal in a movable occluded mould consisting of a hot upstream zone produced from insulating material and a cooled downstream zone in which the metal solidifies, while carrying out by means of a sliding magnetic field, obtained by a series of polyphase inductors, an electromagnetic agitation which causes the dendrites formed in the cold zone to pass into the hot zone where they change to nodules by superficial refusion. This invention is particularly applicable to the production of aluminum plates or bars having thixotropic properties.

2 Claims, 5 Drawing Sheets

METHOD OF PRODUCING THIXOTROPIC METALLIC PRODUCTS BY CONTINUOUS CASTING, WITH POLYPHASE CURRENT ELECTROMAGNETIC AGITATION

BACKGROUND OF THE INVENTION

The invention relates to a method of producing thixotropic metallic products by continuous casting of slabs or billets of circular, elliptical or polygonal cross-section.

A thixotropic metallic product is a metallic product which has a non-dendritic primary phase consisting particularly of dendrites which have degenerated into virtually spherical nodules.

These thixotropic products, when they are shaped, acquire advantages over conventional products:

the shaping energy is less, the cooling period is shortened, the contraction reduced, and mould and die wear is attenuated.

A number of patents disclose means of obtaining thixotropic metallic products:

U.S. Pat. No. 3,948,650 (equivalent to French Patent 2141979) describes a casting method which consists in raising the temperature of a composition until it reaches the liquid state, cooling to produce partial solidification and energetic agitation of the liquid-solid mixture to break up the dendrites and convert them to substantially spherical degenerated nodules representing up to about 65% by weight of the initial composition.

U.S. Pat. No. 4,434,837 describes an electromagnetic agitation apparatus applied to the continuous casting of thixotropic metal in which a stator having two poles creates a magnetic field which rotates in a plane at right-angles to the axis of the ingot mould and which is directed towards this axis. The interaction of this field with the current induced into the metal parallel with this axis generates electromagnetic forces situated in a horizontal plane and tangential in relation to the ingot mould, producing a level of shear of at least 500 $sec^{-1}$.

U.S. Pat. No. 4,457,355 describes an ingot mould consisting of two parts of differing thermal conductivity and European Patent EP 71822 describes an ingot mould consisting of a succession of insulating and conductive metal plates.

U.S. Pat. No. 4,482,012 describes an improvement which consists of using an ingot mould consisting of two chambers connected to each other by a non-conductive seal, the first chamber acting as a heat exchanger and U.S. Pat. No. 4,565,241 advocates agitation conditions such that the ratio of the level of shear to the level of solidification is comprised between $2.10^3$ and $8.10^3$.

SUMMARY OF THE INVENTION

The prior art recalled hereinabove and in particular the conditions fixed in connection with the level of shear show that the essential problem encountered by the inventors is that the electromagnetic forces applied to the metal during the course of solidification must be adequate to break up the dendrites already formed and to convert them to nodules. The degeneration of the dendrites into nodules is achieved by mechanical effect solely and not by a heat effect. Indeed, the forces applied to the dendrites are in the case of round bars tangential to concentric circles centred on the axis of the ingot mould. By virtue of the symmetry of revolution of the ingot mould and of the cast product, these circles are isotherms.

The present invention consists in achieving the conversion of these dendrites into nodules by causing a refusion of the surface of these dendrites by a continuous transfer of the cold zone where they form towards a hotter zone. Therefore, according to the invention, the effect is essentially thermal.

In the method according to the invention, the liquid metal is poured into a mould having a vertical or horizontal axis and with a movable bottom and consisting of:

a so-called hot upstream part, of which the wall or at least its inner face is constructed from a heat insulating material, and a so-called cold downstream part, the wall of which is at least partially constructed from a heat conductive material and is in external contact with a cooling fluid.

In the thermally insulated upstream part, the poured metal remains liquid while in the cooled downstream part, as in the manner which is known in continuous casting, a solidification front forms. Immediately upstream of this front, there is a liquid-solid zone consisting of primary crystals in suspension in still liquid metal.

The invention resides in imparting to this liquid metal, during the course of solidification, a movement which is represented by the arrow in FIG. 1, ensuring a transfer of primary crystals from the cold zone to the hot zone in a time which is less than or equal to 1 second in order to produce a surface refusion of the dendritic crystals and to convert them to degenerated nodules.

This transfer movement is carried out by one or a plurality of polyphase inductors, the disposition of which is explained hereinafter.

DESCRIPTION OF THE PREFERRED EMBODIMENTS

Figure 1:
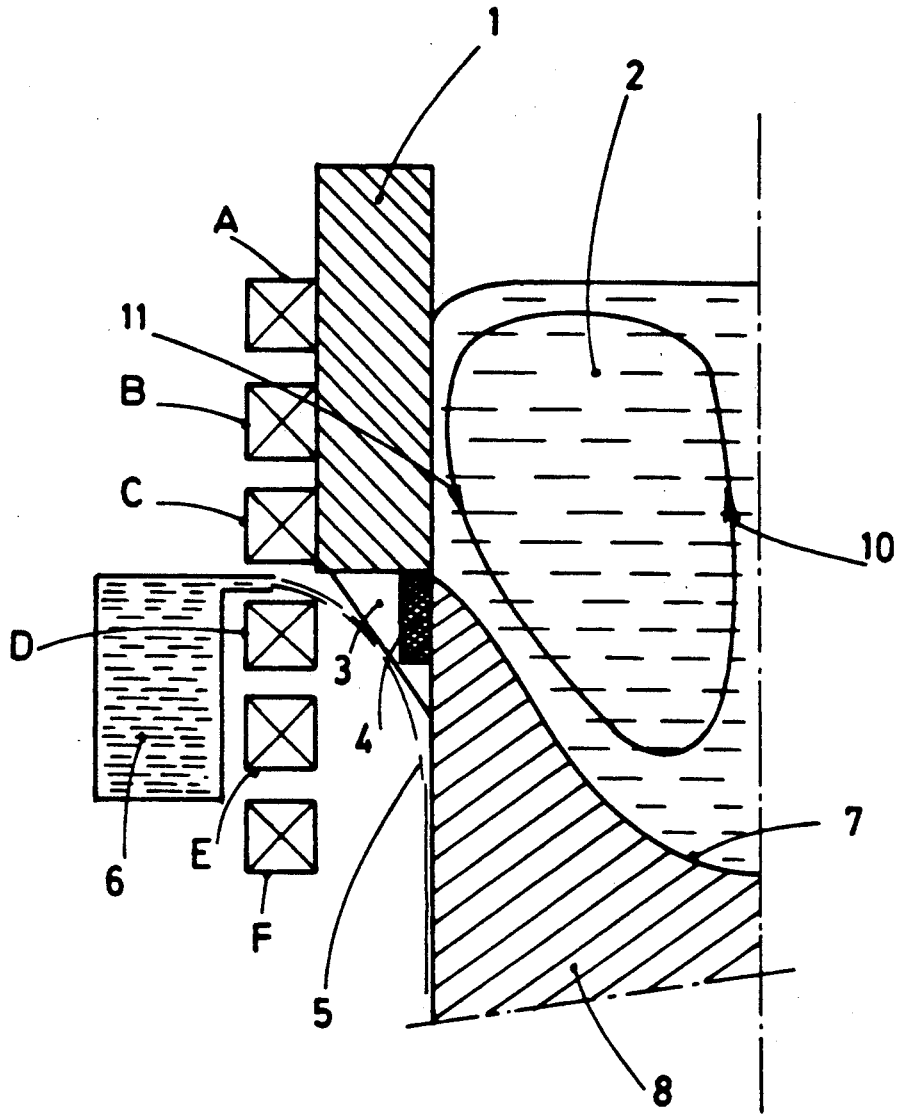
FIG. 1 is a vertical half-section of an apparatus according to the invention.

The continuous casting apparatus intended for carrying out the invention is shown in vertical half-section in FIG. 1. This is an example illustrating a particular embodiment of the invention: that of vertical casting; similar apparatuses having the same functions are found in another embodiment of the invention which is that of horizontal casting.

The casting, solidification and extraction apparatus is close to that used for continuous "hot top" casting of metals and particularly aluminum. It comprises:

a) a hot part made from heat insulating material 1, which contains the liquid metal 2. The insulating material is of the type currently used in foundry work or in making spouts and nozzles.

b) a cold part connected to the hot part in such a way that it is tight to liquid metal. This cold part comprises as its essential element an externally cooled ingot mould 3 of heat conductive metal. Such cooling may be provided by a film of cooling fluid, generally water, 5 emanating from a water container 6 such as that shown in FIG. 1. It may also be provided directly by a water chamber attached to the ingot mould in known manner. In this latter case, water jets or a sheet of water will preferably be formed at the base of the water tank/ingot mould assembly which will trickle down and directly cool the product being cast. In its upper part, this ingot mould may be fitted with a graphite ring 4 acting as a lubricant vis-a-vis the cast metal, supplementing a lubricating agent with which it is sometimes necessary to coat the inside wall of the downstream part in order to facilitate the casting of certain metals. In accordance with a prior art technique, it is also possible to provide a lubricating agent continuously via the ingot mould, so that it passes through the graphite ring and so provides continuous lubrication. Still with a view to continuous lubrication, it is possible instead of using a graphite ring to insert into the ingot mould sticks of graphite which open out onto the inside face of the ingot mould and which are at their other end connected to a chamber in which the lubricant is contained under pressure.

c) the extraction system which consists of a bottom occluding the bottom part of the ingot mould at the start-up and which in the case of vertical casting is carried by a plate to which a regular vertical and downwards movement is imparted which can be adjusted according to the alloys and the format of the products cast. In the case of horizontal casting, this system is carried either by a motorised belt or by a roller table of which one of the rollers is motorised and a presser roller which guarantees the drive.

After starting, the already solidified product serves as a mould for solidification of the metal which is continuously supplied and a state of equilibrium is reached as illustrated in FIG. 1.

Beginning with the ingot mould, a solidified outer shell develops while on the inside of the cast product a solidification front 7 becomes established which has more or less the form shown in the drawing. Below this front, the metal is completely solid; above it, in what is called the "liquid metal pool", there is a mixture of liquid and solid particles, generally dendritic, particles which become progressively integrated into the solidification front, allowing the solid part 8 to develop and allowing the casting to proceed.

The electromagnetic agitating device which, when combined with the casting apparatus, constitutes the invention, consists of one or a plurality of inductors supplied with polyphase current and surrounding the casting apparatus, hot zone and cold zone assembly. In principle, it is possible to use any type of current of n phases, but in practice one will obviously use three-phase current; it is this which is illustrated in FIG. 1.

In this drawing, six successive windings: A, B, C, D, E, F have been shown from top to bottom of the drawing. These windings are disposed in planes at right-angles to the axis of casting. They are supplied in a manner similar to that in which linear induction motors are supplied, respectively via phases 1, −2, 3, −1, 2, −3 in such a way as to create a vertical sliding field which is ascending, descending or periodically ascending and then descending, according to the order in which the three phases are supplied. Conventionally, a winding length is generally used with is a multiple of the polar pitch, the polar pitch being the length of three windings in the elementary sequence 1, −2, 3. This means in practice that 6, 9, 12, 15 . . . windings will be used but in theory nothing prevents a sequence being cut in the middle. Furthermore, means are known to one skilled in the electrical engineering art which consist of using particular windings at the ends in order to eliminate the edge effects which are encountered in linear motors. The interaction of this sliding field with the currents induced in the metal gives rise to forces which induce movements in planes which pass through the axis of the ingot mould and therefore through the cast product. These movements are shown diagrammatically by the arrow 10 in FIG. 1.

It is obvious that these movements permit of entrainment of the dendrites formed close to the solidification front and embedded in the still liquid metal towards the hotter upper part of the liquid metal pool where they undergo superficial fusion which transforms them to nodules and then again towards the cold zone in the direction of the arrow 11.

Figure 2A:
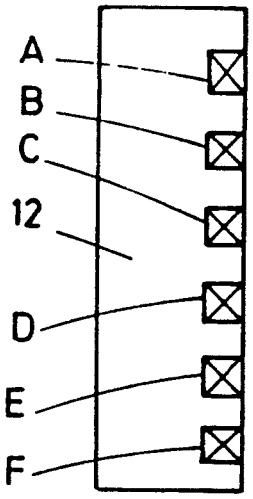
FIG. 2 is a vertical half-section of another embodiment of the apparatus according to the invention.
Figure 2B:
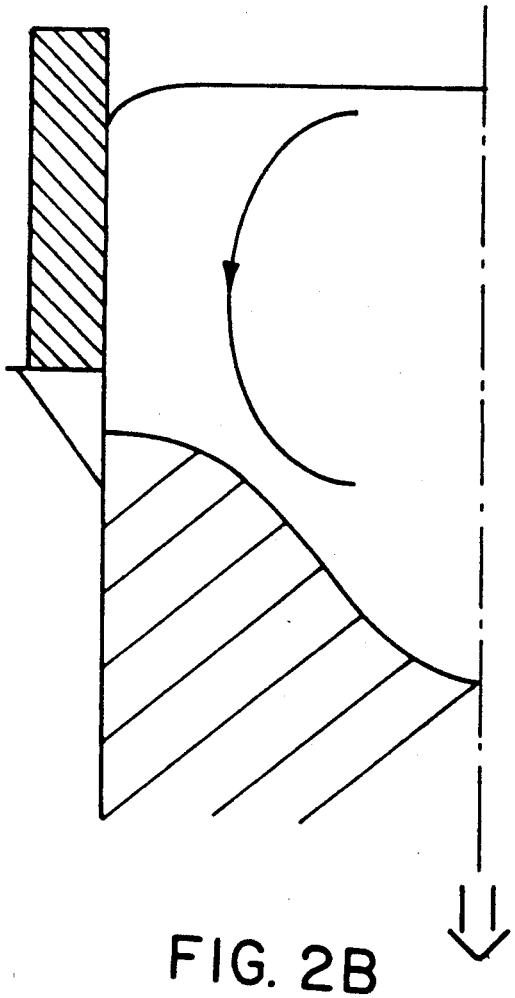

The three phase inductors A to F described hereinabove may be provided in two ways:

1. conventionally with windings in the form of pancake coils of uncooled copper wire or cooled copper tube, the different coils being superposed and preferably placed in notches in a laminated magnetic yoke 12 intended to channel the magnetic force field lines, as shown in FIG. 2. The metallic sheets, insulated electrically from one another, are situated in planes passing through the axis of the mould. In the case of a water chamber being connected to the ingot mould in order to provide for its cooling, the windings can be placed inside this chamber. They are thus effectively cooled.

Figure 3A:
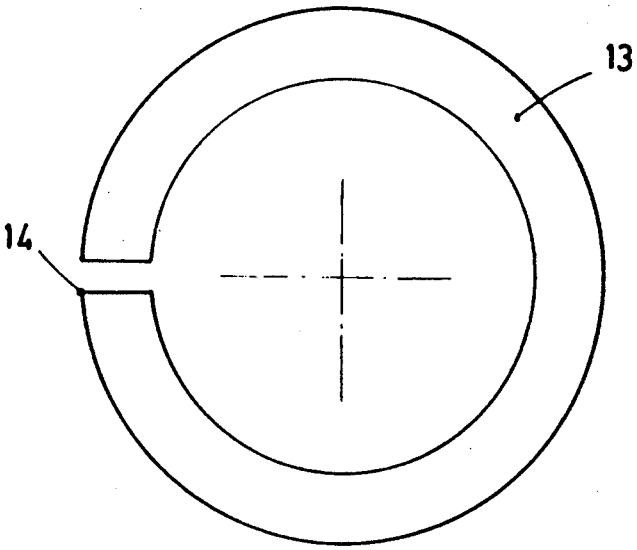
FIGS. 3*a* and 3*b* show an induction winding in plan view and partial cross-sectional view, respectively.
Figure 3B:
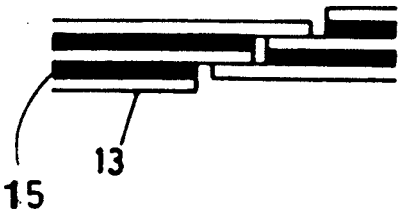

2) According to the invention, as shown in FIG. 3, The winding consists of thin discs of a metal which is a good conductor, cooper for example, the thickness of which is of the order of millimetres. Each disc 13 of a ring shape and provided with a slot 14 constitutes one turn of the winding (FIG. 3*a*). To constitute the winding, the discs are stacked, two successive discs being offset by a given angle. An insulating disc 15 is interposed between two successive copper discs except in the zone between the slots in these two successive discs. Therefore, there is in this zone a contact field to provide an electrical connection between two successive discs and the continuity of the winding (FIG. 3*b*).

Figure 4:
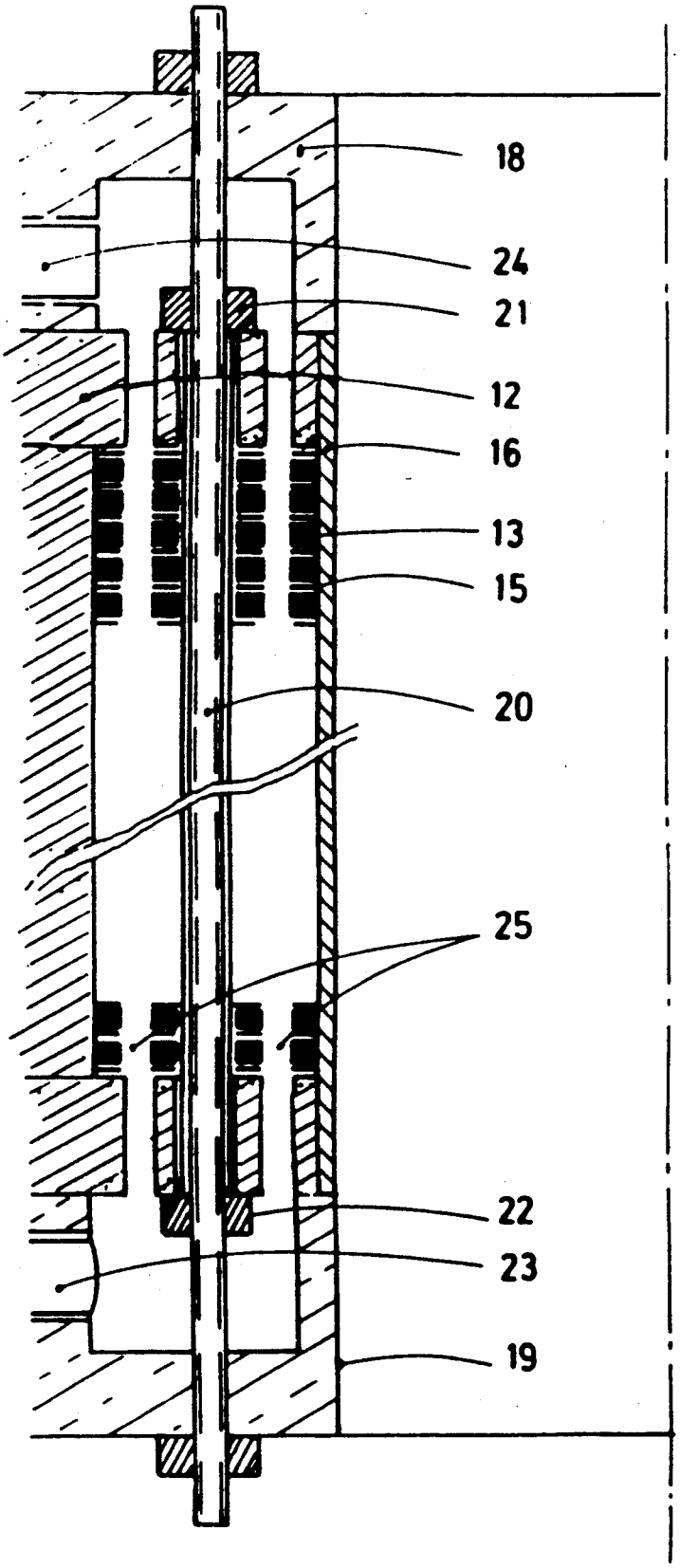
FIG. 4 is a vertical half-section of an annular water chamber with induction windings according to the invention.

To ensure cooling of the cooper discs, two solutions have been conceived, according to the manner in which the ingot mould is cooled. In the event of the ingot mould being cooled by a water film, the windings according to the invention described hereinabove are placed in an annular water chamber surrounding the upstream and downstream parts and allowing passage for the film of water at the level of the ingot mould. A half-section through such a chamber is shown in FIG. 4.

The chamber consists of an inner cylindrical or prismatic wall, according to the form of the product cast, and preferably of an insulating material or a material which is not a good conductor of electricity but in any case a material 16 which is non-magnetic, and an outer wall having a likewise cylindrical or prismatic inner surface which may consist of a magnetic yoke 12.

The water chamber is closed in its upper and lower parts by two members 18 and 19 which are connected to each other by a screwthreaded tie member 20, the purpose of which is likewise to clamp together the discs forming the winding, by means of two nuts 21 and 22.

Its central part which is in contact with the copper discs is insulated.

A water inlet 23 and outlet 24 are disposed respectively at the bottom and top of the chamber. The stacks of copper discs 13 and insulators 15 are disposed inside the chamber. The copper and insulating discs are pierced with holes judiciously distributed in order to constitute cooling ducts 25 and allow passage of tie rods.

Figure 5:
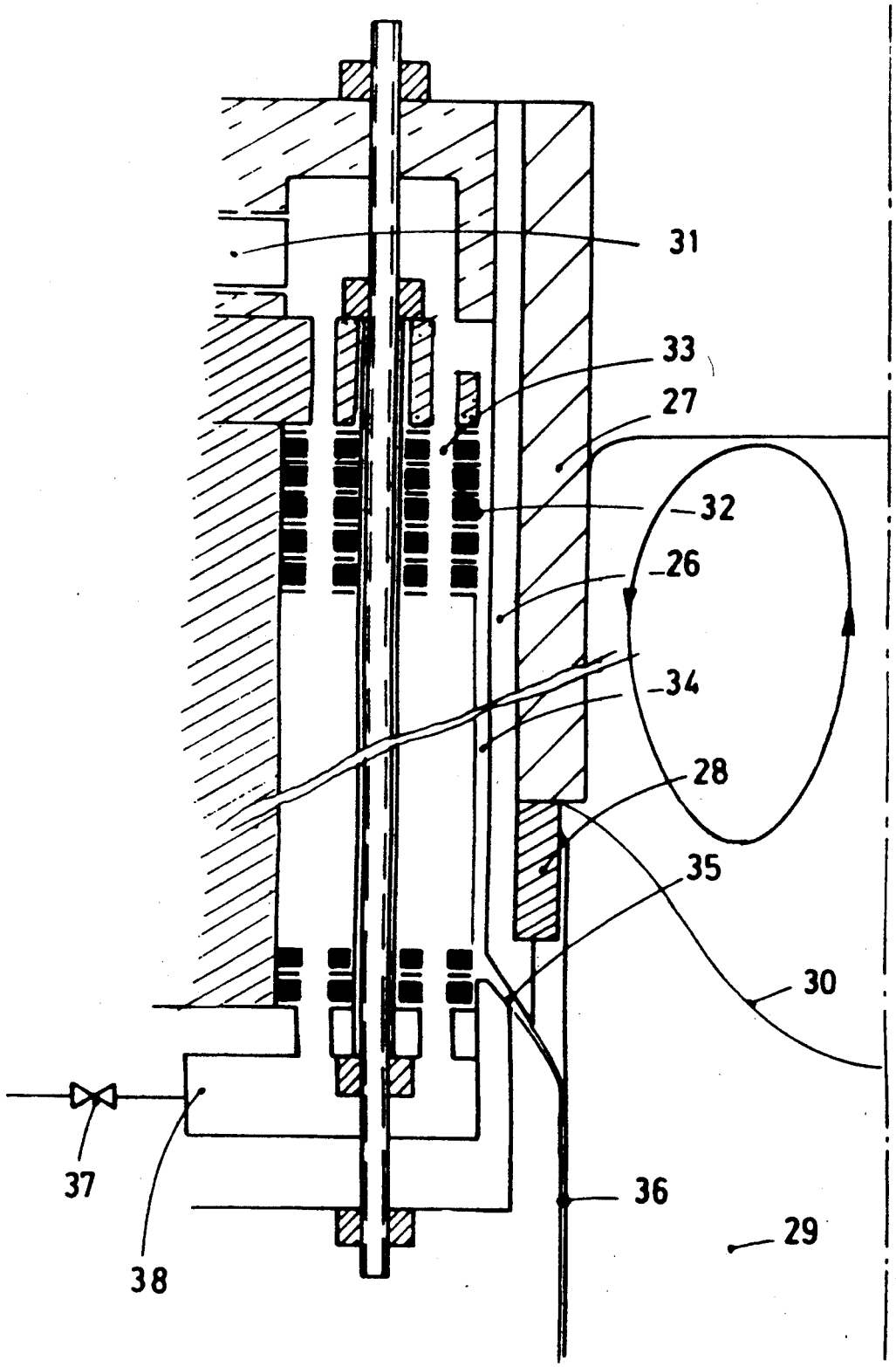
FIG. 5 is a vertical half-section of another annular water chamber according to the invention.

If the ingot mould is cooled by a water chamber, it is possible to take advantage of this solution by placing the windings directly in the chamber as shown in FIG. 5.

The inside wall of the chamber is in this case the ingot mould itself 26 which is coated upstream (hot part) with a heat insulating material 27 and on the downstream side (the cold part) by a graphite ring 28. During the course of casting, the solid part 29 of the product is again found to be bounded by the front 30. The water which arrives at 31 serves not only to cool the windings 32 through the holes 33 and the ingot mould by passage through the interstice 34, but serves also to form the sheet of water 35 which sprinkles over the product at 36. A valve 37 situated on the output circuit 38 from winding cooling makes it possible to monitor the respective quantity circulating in each of the passages. The rest of the technology is similar to that which was described in respect of FIG. 4.

EXAMPLE

A billet of aluminium alloy type $AS_7G_{0.3}$ (AL-7% Si-0.3% Mg) modified with strontium and 150 mm in diameter was cast using the process described hereinabove.

The casting rate was 150 mm/min. The casting temperature was 640° C. The upstream part of the mould consisted of a ring of refractory material with an inside diameter of 145 mm and a height of 100 mm. The downstream part was conventionally shaped like an ingot mould for casting this type of alloy in this diameter. A cylindrical linear motor with a total winding height of 180 mm enclosed these two parts. It consisted of 9 windings each constructed from 15 copper discs 1 mm thick, inside diameter 200 mm and outside diameter 300 mm. The assembly was supplied with three-phase current in a start connection and the voltage applied across the phases was 15 volts.

A micrographic examination of the heart of the billet showed that a degenerated dendritic structure was effectively achieved with a typical globule size of nearly 60 μm.

What is claimed is:

1. A method employing continuous casting to produce thixotropic metallic products and in particular aluminium alloy products of which at least a part of the primary phase takes the form of nodules emanating from degenerated dendrites in which the liquid metal is poured into a mould having an upstream part and a downstream part and occluded in its downstream part by a movable bottom and consisting of two parts of the same axis, which method comprises the steps of:

a) providing the upstream part comprising a hot zone (1) with a wall constructed from heat insulating material at least on its inner surface;

b) providing a downstream part comprising a cold zone (3) with a wall which is made from heat conductive material cooled by a cooling fluid (5) whereby there is provided in the liquid metal the appearance of primary crystals, which crystals effect formation in contact with the cooled wall of a solid crust and a solidification front (7) whereby progressive extraction of the product is effected by downstream movement of the movable bottom; and disposing around the hot and cold zones of the mould a series of inductors consisting of annular windings, the axis of which is the axis of the mould and which are supplied with polyphase current with the phases so arranged that there is inside the mould a sliding field parallel with the axis of the mould and moving in alternating directions giving rise to electromagnetic forces which entrain the metal in movements in planes passing through the axis of the mould and providing for transfer of the dendritic crystals from the cold zone to the hot zone (10) and vice versa (11) in order to bring about a superficial refusion of these crystals and their degeneration into nodules.

2. A method according to claim 1, wherein continuous casting is carried out vertically.

* * * * *